US012324490B1

(12) United States Patent
Herring

(10) Patent No.: US 12,324,490 B1
(45) Date of Patent: Jun. 10, 2025

(54) UNIFORM BADGE ATTACHMENT DEVICE

(71) Applicant: Ron Herring, Montgomery, AL (US)

(72) Inventor: Ron Herring, Montgomery, AL (US)

( * ) Notice: Subject to any disclaimer, the term of this patent is extended or adjusted under 35 U.S.C. 154(b) by 121 days.

(21) Appl. No.: 18/134,816

(22) Filed: Apr. 14, 2023

(51) Int. Cl.
*A44C 3/00* (2006.01)
*A44B 9/16* (2006.01)

(52) U.S. Cl.
CPC ..... *A44C 3/002* (2013.01); *A44B 9/16* (2013.01)

(58) Field of Classification Search
CPC ..... A44C 3/002; A44B 9/16
See application file for complete search history.

(56) References Cited

U.S. PATENT DOCUMENTS 706,168 A * 8/1902 Dover ..... A44B 9/16 24/709.4
1,488,589 A * 4/1924 Engel ..... A44B 9/16 24/709.2
2,457,164 A * 12/1948 Lutz ..... A44C 3/002 24/356
2,795,876 A 6/1957 Hayes
3,806,997 A * 4/1974 Niwa ..... A44B 9/16 24/710
3,953,910 A * 5/1976 Farb ..... B29C 66/7392 156/298
5,457,852 A * 10/1995 Liu ..... A44C 3/001 24/103
6,279,202 B1 * 8/2001 Wojdylak ..... A44B 9/16 40/1.5
8,356,433 B2 1/2013 Babbitt et al.
2011/0265355 A1 * 11/2011 Babbitt ..... A44C 3/002 40/1.5
2017/0347762 A1 * 12/2017 Mandon ..... A44C 5/0007

* cited by examiner

*Primary Examiner* — Gary C Hoge
(74) *Attorney, Agent, or Firm* — Sanchelima & Associates, P.A.; Jesus Sanchelima; Christian Sanchelima

(57) ABSTRACT

A uniform badge attachment device including a sign assembly, a hinge assembly, and a rod assembly. The sign assembly includes an insignia with indicia of a rank, grade, mark or the like in a front side thereof. The hinge assembly includes a hinge support with a hinge lock attached at the rear side of the insignia, wherein a rod is coupled to the hinge support by means of a pin capable of rotating and secured in a predetermined position by the hinge lock. The rod has a sharpened edge adapted to pierce a layer of garment, thereby the rod and a plurality thereof may pierce the layer of garment allowing the rod to be folded and secured in place by means of the pin and the hinge lock, preventing from falling down.

12 Claims, 4 Drawing Sheets

UNIFORM BADGE ATTACHMENT DEVICE

BACKGROUND OF THE INVENTION

1. Field of the Invention

The present invention relates to a uniform badge and, more particularly, to a uniform badge attachment device that includes rods adapted to pierce through the fabric of garment, wherein the badge or insignia is secured in the garment by folding the rods.

2. Description of the Related Art

Several designs for uniform badge attachment devices have been designed in the past. None of them, however, include a plurality of sharpened rods configured to pierce fabric, wherein the plurality of rods includes a hinge mechanism to be folded and secured in place by means of a hinge lock.

Applicant believes that a related reference corresponds to U.S. Pat. No. 8,356,433 issued for badge displaying device. Applicant believes that another related reference corresponds to U.S. Pat. No. 2,795,876 issued for mounting for service ribbons. None of these references, however, teach of a hinged receiving device into which the pins from the badge are inserted, wherein the hinged device secures to the backside of the shirt fabric with the badge on the front side of the shirt fabric.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a device that prevents insignias or badges from falling off.

It is another object of this invention to provide a device that allows the badge or insignia to be held in any garment or uniform.

It is still another object of the present invention to provide a device that may be used to secure in place any rank, insignia, badge or the like.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
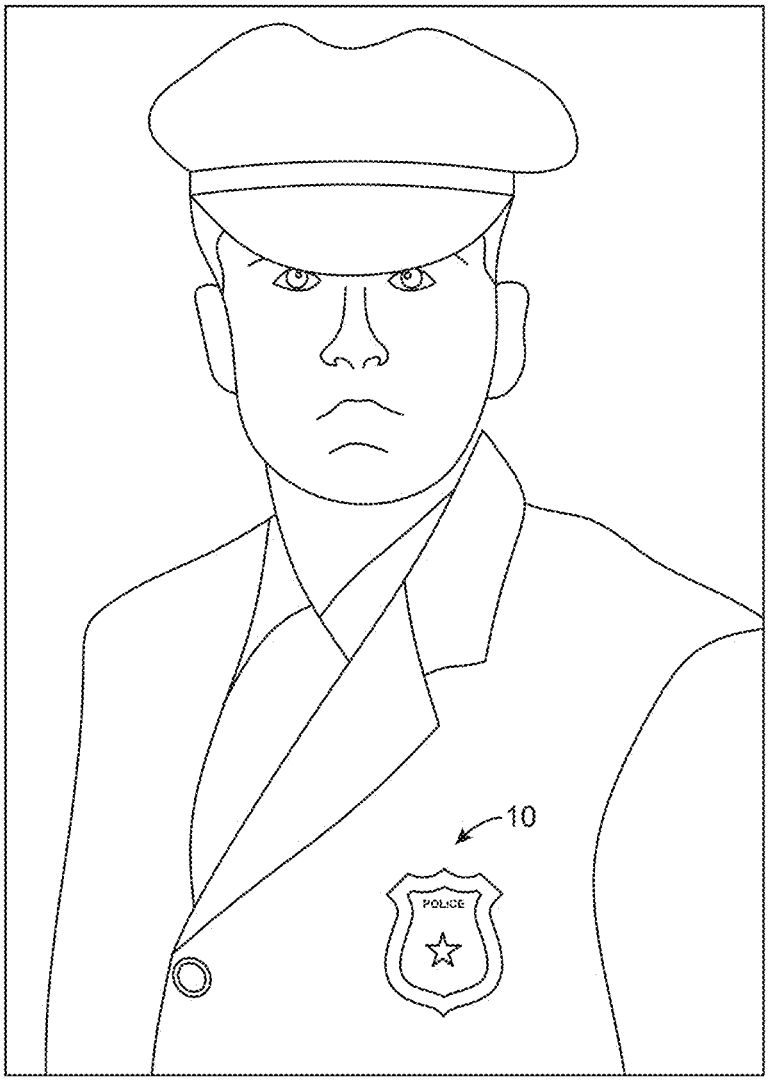
FIG. 1 represents an operational view of an exemplary embodiment of the present invention 10.

Referring now to the drawings, where the present invention is generally referred to with numeral 10, it can be observed that it basically includes sign assembly 20, a hinge assembly 40, and a rod assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 4:
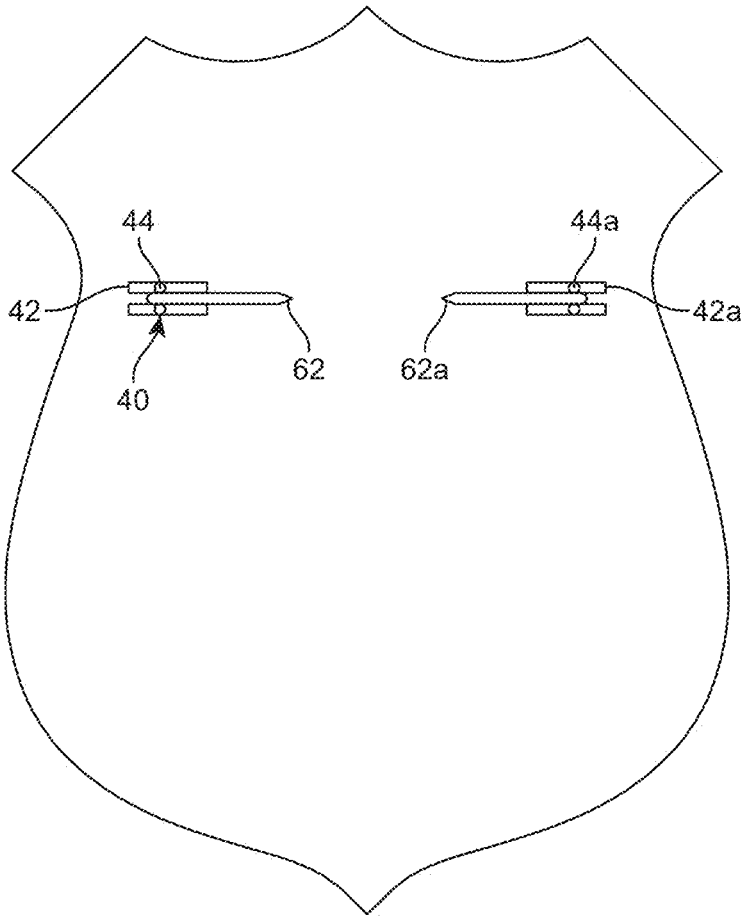
FIG. 4 is a representation of a rear view of the sign assembly 20, wherein the rod assembly 60 is locked in a horizontal configuration by means of the hinge lock 44.
Figure 5:
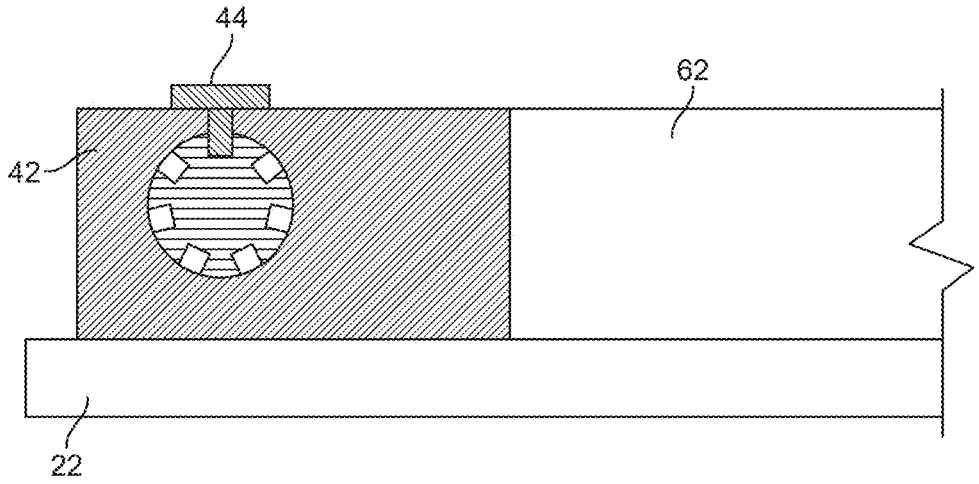
FIG. 5 illustrates a cross-section view of the present invention according to an embodiment thereof.

Sign assembly 20 includes an insignia. In an exemplary embodiment, the insignia 22 may be a sign, mark, badge or any other suitable symbol to distinguish a group, grade, rank, or function wearable on any garment such as a uniform. As best depicted in FIG. 1. In a suitable embodiment, the insignia 22, may be in the form of a circular shape, triangular shape, rectangular shape, nevertheless a combination thereof to form an irregular shape may be considered. As FIG. 4 illustrates. In a preferred embodiment, the front side of the insignia 22 may include decorative elements so that stands it out in relief. The insignia 22 may be made of steel, precious metals, fabric, plastic, a combination thereof or any other suitable material to form a decoration and/or indicia with different elements of a rank, grade, dignity or the like. It should be considered that the edges and rear side of the insignia 22 may be flat, nonetheless, it should be considered that the insignia 22 may include rounded edges or transitional curved edges towards the rear and/or front side of the insignia 22.

Hinge assembly 40 having a hinge support 42, and a hinge lock 44. In an exemplary embodiment, the hinge support 42 may be parallel walls with a separation therebetween attached to a rear portion of the insignia 22 as FIG. 4 illustrates, wherein the hinge support 42 includes an opening symmetrically disposed through the walls thereof, thereby the opening is adapted to receive a pin or any other suitable cylindrical member throughout the hinge support 42. In one embodiment, the hinge support 42 may include a plurality of hinge supports 42*a* in a rear portion of the insignia 22, as FIG. 4 represents. In another exemplary embodiment, the hinge lock 44 may be a looking mechanism included in the hinge supports 42 that allows the pin to rotate until a predetermined position, where the hinge lock 44 may secure in place the pin in a predetermined rotational orientation and may release the pin by applying a predetermined force. In other embodiment, the hinge lock 44 may include a plurality of locks 44*a* included on the plurality of hinge supports 42*a*. As best illustrated in FIG. 4.

Rod assembly 60 includes a rod 62. In an exemplary embodiment, the rod 62 may be a cylindrical member with a sharpened edge adapted to pierce a layer of garment, wherein the rod 62 may be fixed to the pin of the hinge support 42. The rod 62 may rotate freely in conjunction with the pin between the walls of the hinge support 42. In a suitable embodiment, the rod 62 may be made of a metal material allowing the sharpened edge thereof to pierce any suitable garment without breaking or folding the body of the rod 62. It should be considered that the rod 62 may include a plurality of rods 62*a* fixed in the pin of the plurality of hinge supports 42*a*. As FIG. 2 shows.

Figure 2:
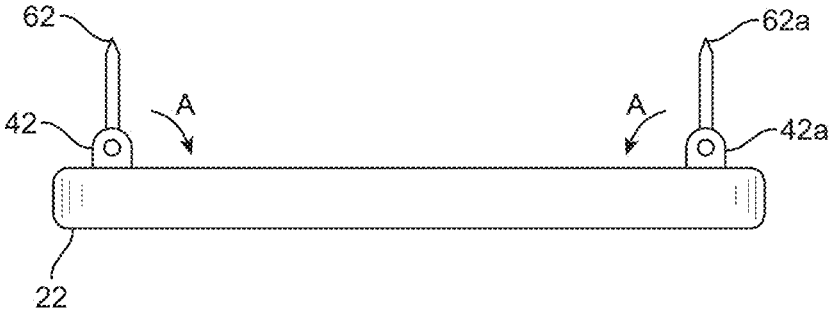
FIG. 2 shows a top view of the insignia 22 while the rod 62 is in a vertical configuration.
Figure 3:
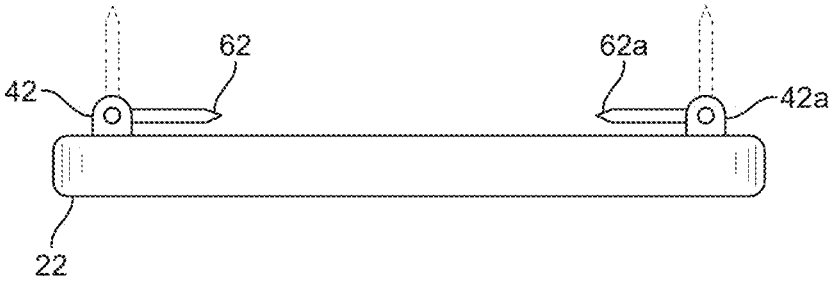
FIG. 3 illustrates a top view of the insignia 22 while the rod 62 is in a vertical configuration.

Referring to the figures, and more particularly to FIG. 2, the rod 62 and the plurality of rods 62*a* may be oriented in a predetermined orientation such as a perpendicular orientation with respect to the rear side of the insignia 22 wherein said orientations is adapted to pierce the layer of garment, therefore, once the rod 62 and the plurality of rods 62*a* have been pierced the layer of garment may be folded or rotated inwardly the rear side of the insignia 22 and secured in place by means of the hinge lock 44 and the plurality of hinge locks 44*a* respectively. As best depicted in FIG. 2 and FIG. 3. It should be considered that the length of the rod 62 and the plurality of rods 62*a* may be suitable to be held in place when mounted on the garment, wherein the rod 62 and the plurality of rods 62 may cause the layer of garment to abut against the rear side of the insignia 22, thereby the insignia 22 may be secured in place and preventing from falling down by means of the locking mechanism of the hinge lock 44 and the plurality of hinge locks 44*a*. As FIG. 1 represents.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A uniform badge attachment device, comprising:

a. a sign assembly including an insignia, wherein said insignia is a sign including indicia of a rank, grade, and or dignity, said insignia is wearable on any garment;

b. a hinge assembly having a hinge support and a hinge lock, wherein said hinge support is attached at a portion of a rear side of said insignia, said hinge lock is coupled to said hinge support; and c. a rod assembly including a rod, wherein said rod is a cylindrical member coupled to said hinge supports and further coupled to said hinge lock, wherein said hinge lock allows said rod to be locked in a predetermined position.

2. The uniform badge attachment device of claim 1, wherein said insignia includes in a front side thereof decorative elements so that stands it out in relief.

3. The uniform badge attachment device of claim 1, wherein said insignia has an irregular shape.

4. The uniform badge attachment device of claim 1, wherein said hinge support comprises two parallel walls with a separation therebetween.

5. The uniform badge attachment device of claim 4, wherein said parallel walls include an opening where a pin is mounted.

6. The uniform badge attachment device of claim 1, wherein said hinge support and said hinge lock includes a plurality of hinge supports and a plurality of locks respectively attached to a rear portion of said insignia.

7. The uniform badge attachment device of claim 5, wherein said pin is coupled to said hinge lock.

8. The uniform badge attachment device of claim 1, wherein said rod includes a sharpened edge adapted to pierce a layer of garment.

9. The uniform badge attachment device of claim 1, wherein said rod is fixed to said pin and further includes a plurality of rods fixed in a plurality of pins coupled to said plurality of hinge supports by means of said openings.

10. The uniform badge attachment device of claim 1, wherein said rod and said plurality of rods are secured in a predetermined position by means of said hinge lock and said plurality of hinge locks respectively.

11. A uniform badge attachment device, comprising:

a. a sign assembly including an insignia, wherein said insignia is a sign including indicia of a rank, grade, and or dignity, said insignia is wearable on any garment, wherein said insignia includes in a front side thereof decorative elements so that stands it out in relief;

b. a hinge assembly having a hinge support and a hinge lock, wherein said hinge support is attached at a portion of a rear side of said insignia, said hinge lock is coupled to said hinge support, wherein said hinge support comprises two parallel walls with a separation therebetween, said parallel walls include an opening where a pin is mounted; and c. a rod assembly including a rod, wherein said rod is a cylindrical member coupled to said hinge supports and further coupled to said hinge lock, wherein said hinge lock allows said rod to be locked in a predetermined position, wherein said rod includes a sharpened edge adapted to pierce a layer of garment.

12. A uniform badge attachment device, consisting of:

a. a sign assembly including an insignia, wherein said insignia is a sign including indicia of a rank, grade, and or dignity, said insignia is wearable on any garment, wherein said insignia includes in a front side thereof decorative elements so that stands it out in relief, said insignia has an irregular shape;

b. a hinge assembly having a hinge support and a hinge lock, wherein said hinge support is attached at a portion of a rear side of said insignia, said hinge lock is coupled to said hinge support, wherein said hinge support is comprised of two parallel walls with a separation therebetween, said parallel walls include an opening where a pin is mounted, said hinge support and said hinge lock includes a plurality of hinge supports and a plurality of locks respectively attached to a rear portion of said insignia, said pin is coupled to said hinge lock; and c. a rod assembly including a rod, wherein said rod is a cylindrical member coupled to said hinge supports and further coupled to said hinge lock, wherein said hinge lock allows said rod to be locked in a predetermined position, wherein said rod includes a sharpened edge adapted to pierce a layer of garment, said rod is fixed to said pin and further includes a plurality of rods fixed in a plurality of pins coupled to said plurality of hinge supports by means of said openings, said rod and said plurality of rods are secured in a predetermined position by means of said hinge lock and said plurality of hinge locks respectively.

* * * * *